United States Patent [19]

Röck et al.

[11] 4,045,841

[45] Sept. 6, 1977

[54] HINGE

[76] Inventors: Erich Röck, Kuferstrasse 1085, A-6973 Hochst; Bernhard Mages, Harte 10, A-6850 Dornbirn, both of Austria

[21] Appl. No.: 673,893

[22] Filed: Apr. 5, 1976

[30] Foreign Application Priority Data

| | | |
|---|---|---|
| Apr. 7, 1975 | Austria | 2623/75 |
| Dec. 2, 1975 | Austria | 9174/75 |

[51] Int. Cl.[2] ..... E05D 7/04

[52] U.S. Cl. ..... 16/129

[58] Field of Search ..... 16/129–134

[56] References Cited

U.S. PATENT DOCUMENTS

| | | | |
|---|---|---|---|
| 3,772,735 | 11/1973 | Lautenschlaeger | 16/129 |
| 3,890,670 | 6/1975 | Sewing et al. | 16/129 |
| 3,938,219 | 2/1976 | Rock et al. | 16/130 |
| 3,952,364 | 4/1976 | Lautenschlaeger | 16/128 R X |
| 3,977,041 | 8/1976 | Rock et al. | 16/129 |

*Primary Examiner*—G. V. Larkin

[57] ABSTRACT

A hinge arrangement in which a base plate attachable to a part of furniture, provides an anchor for a hinge arm carrying toggle joints. The hinge arm has an end remote from mounting points of spindles of the toggle joints, which is provided with a longitudinal slot. A screw carried in the base plate, passes through the slot, and a holding shoulder is located directly or indirectly on the hinge arm between the longitudinal slot and the mounting points for the toggle joint spindles. The shoulder grips behind a projection on the base plate. The holding shoulder, furthermore, is disposed on an intermediate element connected adjustably with the hinge arm, and which is in the form of a female threaded element, receiving an adjusting screw held in the hinge arm.

18 Claims, 11 Drawing Figures

HINGE

BACKGROUND OF THE INVENTION

The present invention relates to a hinge, in particular for doors in furniture, with a base plate attachable to part of a piece of furniture. In this base plate a hinge arm carrying toggle joints or the like is anchorable.

Such hinges are widely used in the furniture industry and here in particular in the kitchen furniture industry. In these hinges the base plate is secured to a part of a piece of furniture, for example a side wall of a piece of furniture, by means of screws, dowels or the like. The hinge arm, connected to a dowel cup or similar by means of toggle joints, is located on the base plate when the door leaf of the piece is hung.

Thus the piece can be pre-assembled. First the base plate, as stated, is secured to the side wall of the piece and then the dowel cup on which the hinge arm is articulated is inserted in a corresponding dowel hole in the door leaf of the piece.

Now, essentially these hinges are subject to two requirements. When hanging the door leaf of the piece, the hinge arm should be rapidly anchorable on the base plate and held thereon so that the weight of the door leaf does not have to be supported too long. In addition, there should be one or more adjustment possibilities to allow compensation for any tolerances which have arisen; for example, when drilling the fixing holes in the parts of the piece. During this adjustment moreover it must not be necessary for the person entrusted with the work to have to support the door leaf of the piece.

SUMMARY OF THE INVENTION

A hinge that meets the preceding requirements is obtained in accordance with the present invention by providing that at its end remote from the mounting points for the toggle-joint spindles, the hinge arm has a longitudinal slot through which a screw mounted in the base plate is passed. In that space between the longitudinal slot and the mounting points for the toggle-joint spindles at least one holding shoulder is provided directly or indirectly disposed on the hinge arm. This shoulder engages behind a projection or projections on the base plate.

In the case of this hinge the screw is already screwed into the base plate before the hinge arm is located on the base plate. The hinge arm can now be pushed onto the base plate and is held there in its front area by the holding shoulder or shoulders and in its rear area by the screw. The longitudinal slot allows movement of the hinge arm along the longitudinal median axis of the base plate and the hinge arm provides the possibility of adjustment of the hinge as regards depth in the piece of furniture.

In order to obtain the possibility of adjustment as regards gap in the piece, a provision is made, in a preferred form of embodiment of the invention, for the holding shoulder to be disposed on an intermediate piece connected adjustably to the hinge arm.

The intermediate piece can be constituted, for example, of a female threaded piece in the thread of which is engaged an adjusting screw held in the hinge arm.

A further embodiment example of the invention provides for the intermediate piece to be constituted of a threaded bolt which engages in a female thread in the hinge arm and exhibits the preferably circular holding shoulder at its end facing the base plate. With this embodiment the gap-adjustment is obtained with one part only.

In addition, provision is made in one embodiment example for the longitudinal slot to be made the shape of a keyhole through which the hinge arm 1 can be located over the head of the screw, and the screw then pushed into the narrow part of the slot.

This possibility of pushing the screw in can also be ensured by having the longitudinal slot open to the end of the hinge arm. With such an embodiment example, it is advantageous for the edge of the longitudinal slot to be beveled and for this bevelling to take the screw head. This results in support for the screw head at the end of the slot as well so that any tendency for the hinge arm to slip out when the screw is not fully tightened is avoided. This effect can also be obtained by a nose, preferably two noses, disposed at the end of the longitudinal slot on the hinge arm.

Advantageously a provision is made for the screw to be screwed in a socket formed on the base plate. This socket can provide a lateral guide for the hinge arm at the same time.

In order to further counteract any tendency for the hinge arm to slip off the base plate when the screw is not fully tightened and, in addition, to hold the hinge arm securely fixed to the base plate when the screw is tightened, a provision is made, in one embodiment example, for the socket and/or the hinge arm to be ribbed in the area of the longitudinal slot.

In another embodiment example the lateral support of the hinge arm in relation to the base plate is improved in that the U-section hinge arm exhibits beading on the inside of its parallel faces. Advantageously, lateral guide walls for the hinge arm are also provided in the area of the projection on the base plate such that when beading is formed in this area it bears on the lateral guide walls.

Now in order to obtain vertical adjustment in the piece of furniture with such a hinge, in addition to the possibilities of depth and gap adjustment in the piece as already mentioned, a provision is made in an embodiment example of the invention for a fixing plate to be disposed between the socket and the lateral guide walls. This fixing plate is located over the base plate and in practice clamps the latter between itself and the part of the piece of furniture. The fixing plate is attachable by means of supporting screws, or the like, to this part of the piece and holds the base plate on this part of the piece of furniture in the assembled position. Here the fixing plate is normally aligned with the base plate.

To ensure with this embodiment that the base plate does not become twisted under the load of the door leaf, a provision is advantageously made for the base plate and the fixing plate to engage together by means of corresponding protrusions and recesses. For this the protrusions and the recesses exhibit side faces disposed parallel to one another which are normally aligned with the longitudinal median axis of the hinge arm and the base plate. Advantageously, a provision is made for the recesses to be formed in the base plate and for the protrusions to be made on the fixing plate.

In this way, the means for vertical adjustment are concealed from the outside and the viewer is faced with a smooth surface which is desirable from the aesthetic standpoint.

In order to make the hinge as solid as possible in regard to its vertical adjustment, a provision is also made for the supporting screws of the fixing plate to be located in the protrusions.

Although the vertical adjustment or setting might be achieved merely by pressing the fixing plate onto the base plate, in a preferred embodiment example a vertical adjustment screw is provided which connects the base plate and the fixing plate in the assembled position. In this way one first achieves uniform pressure; secondly the supporting screws can be screwed as far as possible into the part of the piece of furniture right at the start of assembly to ensure the best possible support.

BRIEF DESCRIPTION OF THE DRAWINGS

Following various embodiment examples of the invention are described with reference to the figures in the attached drawing without it being intended that these embodiment examples be understood as limitative.

DESCRIPTION OF THE PREFERRED EMBODIMENTS

Figure 1:
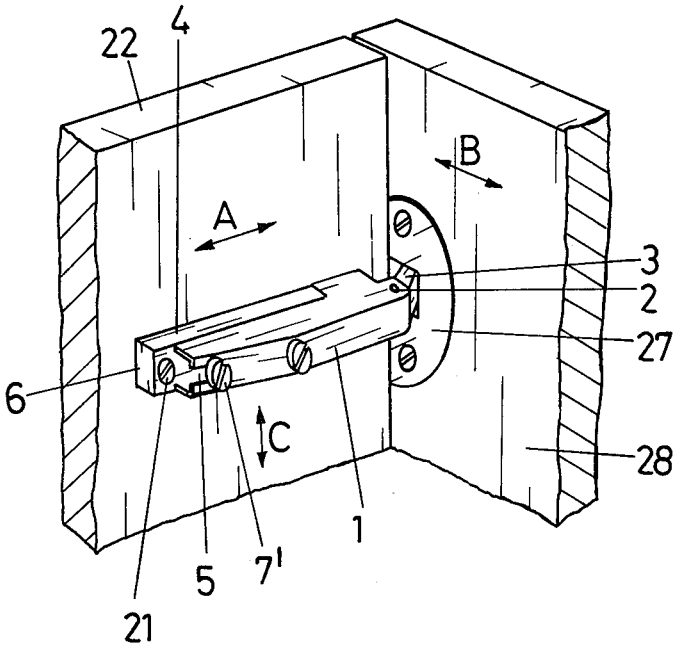
FIG. 1 shows a hinge in accordance with the invention pictorially.
Figure 2:
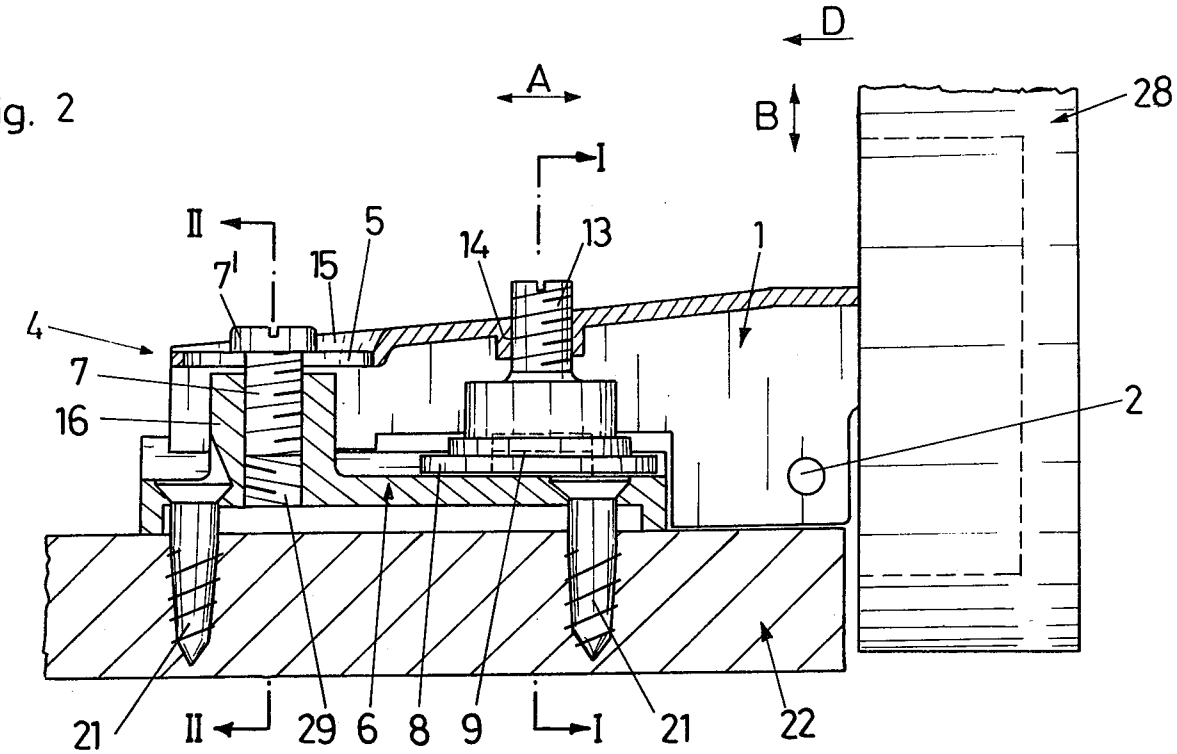
FIG. 2 shows a longitudinal section through a hinge in accordance with the invention in which the toggle joints and the dowel cup on the door leaf are not drawn.
Figure 3:
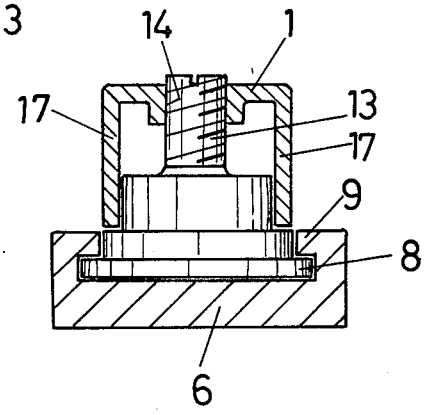
FIG. 3 shows a section along line I—I in FIG. 2.

As can be seen in FIG. 1 in particular, the hinge, in accordance with the invention, essentially consists of the base plate 6, the hinge arm 1 and the dowel cup 27. The hinge arm 1 and the dowel cup 27 are connected together by means of toggle joints 3. The dowel cup 27 is inserted in a hole in the door leaf 28. The base plate 6 is secured to the other part of the piece of furniture 22, which may be a side wall of a piece of furniture for example, by means of supporting screws 21.

In this figure one can also see the longitudinal slot 5 which is open to the end 4 of the hinge arm 1, the head 7' of the screw 7 which passes through this slot 5, and another screw end which belongs to the second retention means for the hinge arm 1. This drawing, however, does not show whether this is the head of the adjusting screw or the end of the intermediate piece in the form of a threaded bolt.

This figure also indicates the desired adjustment possibilities by means of arrows. Arrow A shows the direction of depth adjustment in the piece of furniture, arrow B the direction for adjusting the door gap, and arrow C the direction for vertical adjustment in the piece.

FIGS. 2 to 5 show an embodiment example of the hinge in accordance with the invention in which an intermediate piece in the form of a threaded bolt 13 is provided. A hinge in this embodiment permits vertical adjustment in the piece of furniture (arrow A) and adjustment of the door gap (arrow B).

This embodiment example is now described.

The base plate 6 is secured to the part of the piece of furniture 22 by means of supporting screws 21. To the rear the base plate 6 is provided a socket 16 which has an internal thread 29 into which the screw 7 is threaded. To the front the base plate 6 has projections 9 aligned with its longitudinal median axis, as is particularly clear from FIG. 3.

The hinge arm 1 is provided with a female thread 14 into which the intermediate piece in the form of a threaded bolt 13 is inserted. In addition, the hinge arm 1 has the longitudinal slot 5 at its end 4 remote from the mounting points 2 for the toggle-joint spindles. The longitudinal slot 5 is shaped like a keyhole (see FIG. 5 in particular).

To fit the door leaf 28 the hinge arm 1 is now placed on the base plate 6 in such a way that the screw head 7' is passed through the longitudinal slot 5 at its widened end 5' whereupon the hinge arm 1 is then moved in the direction of arrow D so that the holding shoulder 8 of the threaded bolt 13 comes to rest under the projections 9 on the base plate 6.

In this way the hinge arm 1 is securely anchored on the base plate 6 and the door leaf 28 is thereby held.

By twisting the threaded bolt 13 the adjustment, or better the setting, of the hinge as regards door-gap (arrow B) can be carried out. On completion of the door-gap adjustment, the hinge arm 1 can be moved over a certain range in the direction of arrow A so that it is exactly aligned in regard to depth in the piece of furniture. After this, the screw 7 is tightened and the hinge arm 1 is fixed.

Figure 4:
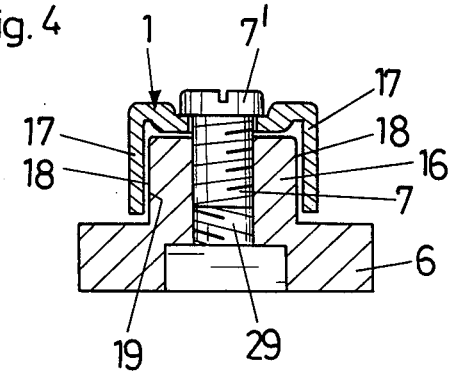
FIG. 4 shows a section along the line II—II in FIG. 2.
Figure 5:
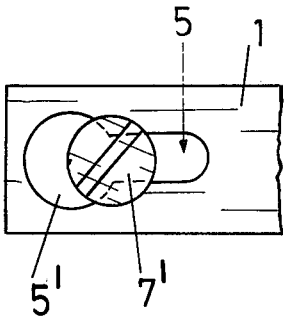
FIG. 5 shows a top view of a hinge in accordance with the invention in the area of the end of the hinge arm.

In FIG. 4 beading 18 disposed on the parallel faces 17 of the hinge arm 1 can be seen. This beading bears on the guide walls 19 at the side formed on the socket 16. Through this, more precise guidance of the hinge arm 1 is achieved.

Figure 6:
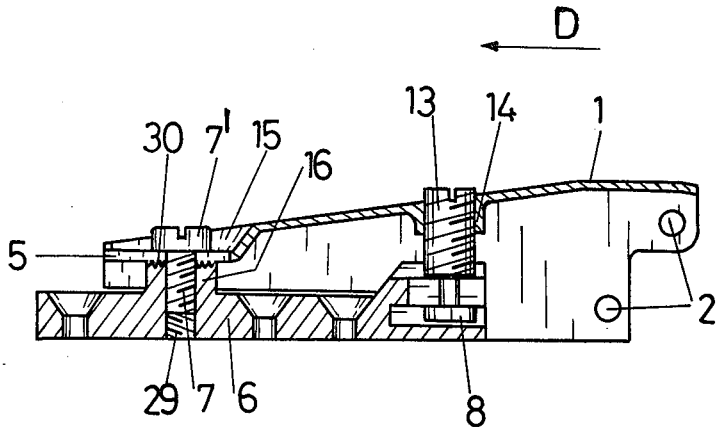
FIG. 6 shows a longitudinal section through a further embodiment example of a hinge in accordance with the invention, the toggle joints and the dowel cup on the door leaf again being omitted.
Figure 7:
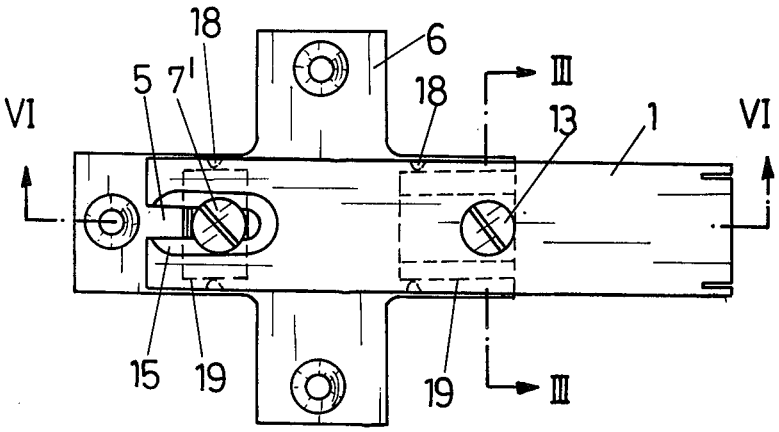
FIG. 7 shows a top view of a hinge in accordance with the invention as in FIG. 6.

FIGS. 6 and 7 show a further embodiment example of the invention which is described below. Once again the part of the piece of furniture 22 and the door leaf 28 are not shown, like the supporting screws 21 for the base plate 6.

The base plate 6 again has a socket 16 with an internal thread 29 in which the screw 7 is inserted. Similarly the base plate 6 is provided with projections 9 behind which engages the holding shoulder 8 of the intermediate piece in the form of a threaded bolt 13.

In distinction to the embodiment example described previously, this time the longitudinal slot 5 is open to the rear end of the hinge arm 1 so that when the hinge arm 1 is placed on the base plate 6, the hinge arm 1 can simply be pushed in from the front in the direction of the arrow D. At the same time its rear end passes under the head 7' of the screw 7 while the front end the holding shoulder 8 of the threaded bolt 13 passes under the projections 9.

In a manner similar to that of the embodiment example previously described, the hinge arm 1 is thus anchored on the base plate 6. Then, adjustment of the door gap can be effected again by twisting the threaded bolt 13, after which the adjustment of the depth in the piece of furniture can be carried out by moving the hinge arm 1 in the direction of arrow A. The hinge arm 1 is then resecured on the base plate 6 by tightening up the screw 7.

As can be seen in FIGS. 6 and 7, in the area of the longitudinal slot 5 there is bevelling 15 which receives the head 7' of the screw 7. Through this bevelling 15 a certain hold on the hinge arm 1 is obtained to prevent it from slipping out of its anchorage even when the screw 7 is not fully tightened.

In this embodiment example it can also be seen that the socket 16 and the base plate side of the hinge arm 1 are each provided with ribbing 30 which improves the support between base plate 6 and hinge arm 1.

In FIG. 7 the beading 18 and the lateral guide walls 19 are shown by the dotted line.

Figure 8:
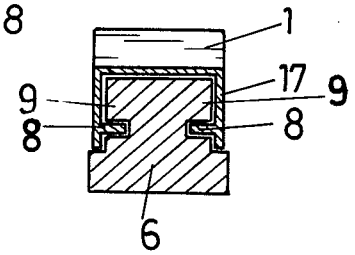
FIG. 8 shows a cross-section through a hinge in accordance with the invention in the area of the line III—III in FIG. 7, this cross-section showing an embodiment example of the hinge in accordance with the invention without the intermediate piece.

FIG. 8 shows an embodiment example corresponding to the embodiment example in FIGS. 6 and 7 in which, however, the threaded bolt 13 and any intermediate piece is omitted. The figure drawn shows a section along the line III—III in FIG. 7 produced in these circumstances.

While the area of the hinge arm 1 and the base plate 6, remote from the mounting points 2 for the toggle-joint spindles, is completely identical to FIGS. 6 and 7, in the area of the front mounting the holding shoulders 8 are moulded or attached directly to the two parallel faces 17 of the hinge arm 1. These holding shoulders 8 again engage behind projections 9 on the base plate 6 which has a T-shaped cross-section in this area.

With such an embodiment example the same rapid anchoring is possible as with the one described previously, as is also the possibility of depth adjustment. This embodiment example, however, does not offer the possibility of adjusting the door gap.

However, in many cases this disadvantage is offset by the reduced production costs.

Figure 9:
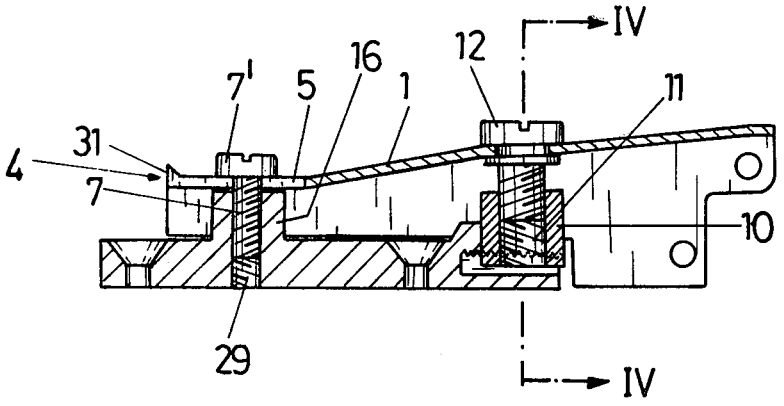
FIG. 9 shows a longitudinal section through a hinge in accordance with the invention with another embodiment of the intermediate piece.
Figure 10:
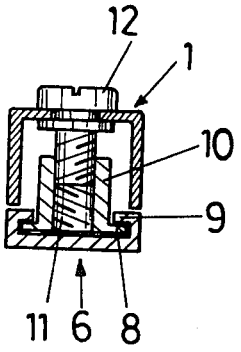
FIG. 10 shows a cross-section through a hinge in accordance with the invention along the line IV—IV in FIG. 9.

FIGS. 9 and 10 show a further embodiment example of the hinge in accordance with the present invention with an intermediate piece. This intermediate piece is made as a female threaded piece 10 which has a thread 11 in which an adjustment screw 12, held in the hinge arm 1, engages.

The female threaded piece 10 again has holding shoulders 8 which engage behind projections 9 on the base plate 6 in the assembled position.

The longitudinal slot 5 is again made open to the end 4 of the hinge arm 1 and has passing through it the screw 7 inserted in an internal thread 29 of the socket 16.

To ensure with this embodiment example as well that a certain hold is maintained, when the screw 7 is not fully tightened, to prevent the hinge arm 1 from slipping out, noses 31 are provided at the edge of the longitudinal slot 5 at the end of the hinge arm 1 on which noses the head 7' of the screw 7 can bear.

In this embodiment example anchorage, adjustment and securing of the hinge arm 1 is effected in the same way as in the embodiment example in FIGS. 6 and 7. Here again, there is the possibility of depth adjustment in the piece of furniture and door-gap adjustment.

Figure 11:
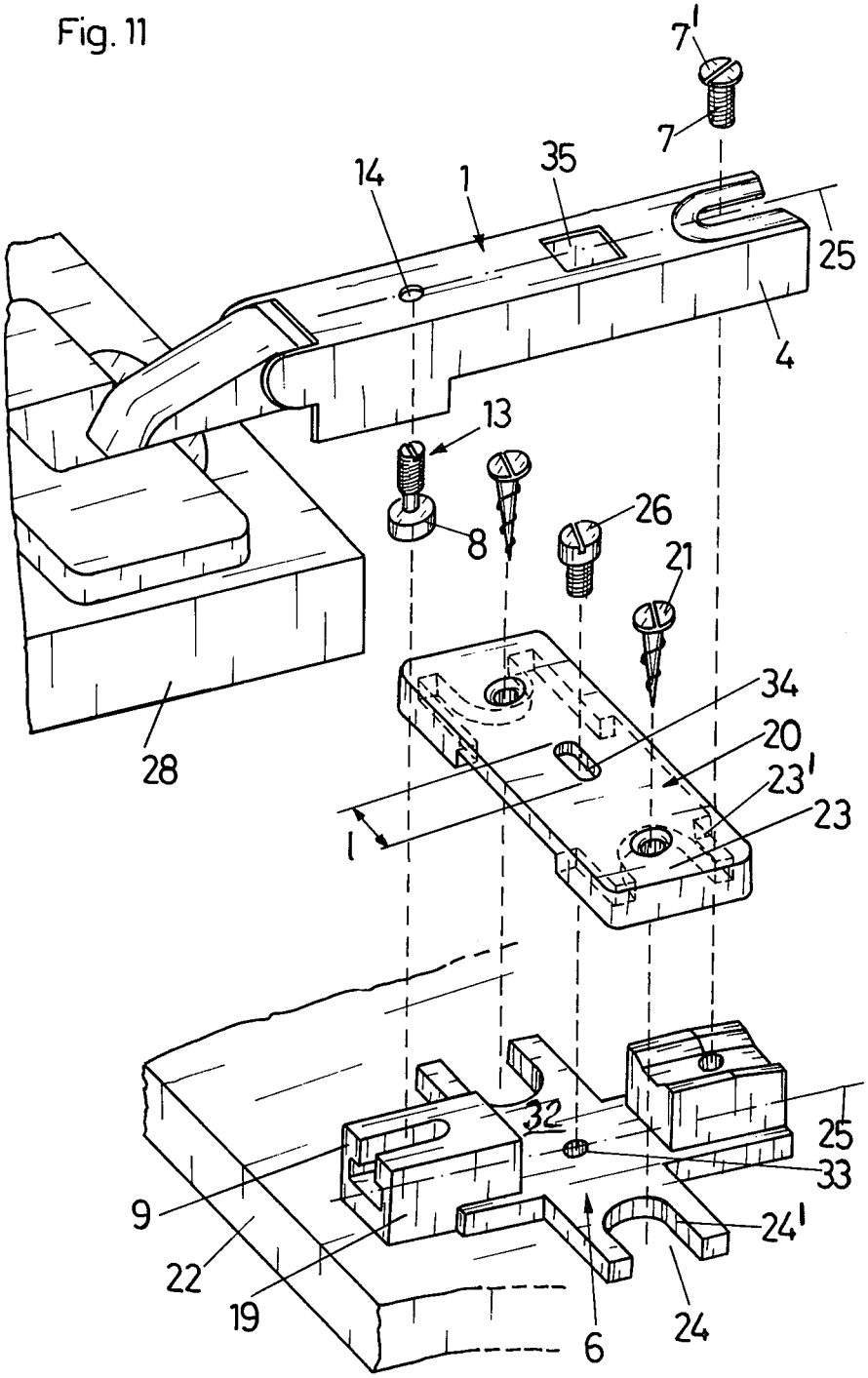
FIG. 11 shows a further embodiment example of a hinge in accordance with the invention pictorially.

In the embodiment example of the hinge, in accordance with the invention shown in FIG. 11, there is a possibility of vertical adjustment in addition to the possibilities of depth adjustment and door-gap adjustment in the piece of furniture.

This embodiment example is described below:

The base plate 6 is anchored with the fixing plate 20 to the part of the piece of furniture 22 in this embodiment example. The fixing plate 20 covers the base plate 6 and is secured by means of supporting screws 21 directly to the part of the piece 22. The base plate 6 is held to the part of the piece of furniture 22 by means of the fixing plate 20.

The base plate 6 has a central web 32 normally aligned with the longitudinal axis 25 of the hinge arm 1 and the base plate 6. This central web is provided with U-shaped recesses 24 at both its ends. In the assembled position corresponding protrusions 23 on the fixing plate 20 engage in these U-shaped recesses 24 so that the fixing plate 20, fixed to the furniture part 22 by the supporting screws 21, guides the base plate 6 and holds it from twisting by means of the side walls 24' of the recesses 24.

In addition, the base plate 6 has a female thread 33 for the vertical adjustment screw 26 which passes through a slot 34 in the fixing plate 20.

The base plate 6 is now adjustable vertically in the piece of furniture over the length 1 of the slot 34. On completion of the adjustment the vertical adjustment screw 26 is tightened and the base plate 6 is thus held to the fixing plate 20.

The hinge arm 1 is again provided with an intermediate piece in the form of a threaded bolt 13 which is inserted in the female thread 14 of the hinge arm 1. This can be pushed with its head which forms the circular holding shoulder 8 into a T-shaped groove in the base plate 6. In this way, the holding shoulder 8 again engages behind the projections 9 on the base plate 6.

At its end 4 remote from the mounting points 2 for the toggle-joint spindles, the hinge arm 1 is again provided with the slot 5 which is open to the rear.

This slot 5 has the screw 7 passing through it as in the embodiment examples described previously.

The depth adjustment in the piece of furniture and the door-gap adjustment are effected exactly as in the embodiment examples described previously, as is the anchoring of the hinge arm 1 on the base plate 6.

In addition, the hinge arm 1 has an opening 35 which makes it possible to slacken or tighten the vertical adjustment screw 26 with the hinge arm 1 located in place. In this way the vertical adjustment of the base plate 6 can be effected with the hinge arm 1 located and the door leaf 28 attached, thereby permitting accurate insertion of the door leaf 28.

At least one projection 31 may be located at the end of the longitudinal slot 5. The holding shoulder 8 grips behind the projection element 9 on the base plate 6. An intermediate element 13 supports the holding shoulder 8 and is connected adjustably with the hinge arm 1.

We claim:

1. A hinge arrangement comprising, in combination, a base plate attachable to furniture means; a hinge arm carrying toggle joint means and being anchorable in said base plate; said toggle joint means having pivot means; said hinge arm having means for mounting said pivot means at one end of said hinge arm; said hinge arm having a longitudinal slot at another end of said hinge arm spaced from said mounting means for said pivot means of said toggle joint means; screw means passing through said slot and carried in said base plate; said hinge arm including a holding shoulder between said longitudinal slot and said mounting means for said pivot means; projecting means on said base plate, said holding shoulder gripping behind said projection means on said base plate.

2. The hinge arrangement as defined in claim 1 including an intermediate element supporting said holding shoulder, said intermediate element being connected adjustably with said hinge arm.

3. The hinge arrangement as defined in claim 2 including adjusting screw means in said hinge arm, said intermediate element comprising a female threaded element having a thread engaged by said adjusting screw means.

4. The hinge arrangement as defined in claim 2 including a female thread in said hinge arm, said intermediate element comprising a threaded bolt engaging said female thread in said hinge arm, said holding shoulder being substantially circular and being on the intermediate element at an end facing said base plate.

5. The hinge arrangement as defined in claim 1 wherein said longitudinal slot has a keyhole-shape.

6. The hinge arrangement as defined in claim 1 wherein said longitudinal slot is open to one end of said hinge arm.

7. The hinge arrangement as defined in claim 6 wherein said longitudinal slot is beveled for receiving the head of a screw.

8. The hinge arrangement as defined in claim 6 including at least one projecting portion at one end of said longitudinal slot.

9. The hinge arrangement as defined in claim 1 including socket means on said base plate for receiving said screw means.

10. The hinge arrangement as defined in claim 9 including ribbing means on at least one of said socket means and said hinge arm in the area of said longitudinal slot.

11. The hinge arrangement as defined in claim 9 wherein said hinge arm has a U-shaped cross-section with beading means on the inside of its parallel faces.

12. The hinge arrangement as defined in claim 1 including lateral guide walls in proximity of said projection means for said hinge arm.

13. The hinge arrangement as defined in claim 12 including socket means on said base plate for receiving said screw means; a fixing plate between said socket means and said lateral guide walls above said base plate, said fixing plate being attachable to a part of said furniture means and holding the base plate to said furniture part when in assembled position, said fixing plate being substantially aligned with said base plate.

14. The hinge arrangement as defined in claim 13 including protrusions and recesses for connecting said base plate and said fixing plate.

15. The hinge arrangement as defined in claim 14 wherein said protrusions and recesses have side faces parallel to one another and substantially aligned with a longitudinal median axis of said hinge arm and said base plate.

16. The hinge arrangement as defined in claim 14 wherein said recesses are arranged in said base plate and said protrusions are arranged in said fixing plate.

17. The hinge arrangement as defined in claim 16 including supporting screws in said protrusions for supporting said fixing plate.

18. The hinge arrangement as defined in claim 13 including a vertical-adjustment screw connecting said base plate and said fixing plate together when in assembled position.

* * * * *

REEXAMINATION CERTIFICATE (1408th)

United States Patent [19] [11] B1 4,045,841

Röck et al. [45] Certificate Issued Jan. 29, 1991

[54] HINGE

[75] Inventors: Erich Röck, Hochst; Bernhard Mages, Dornbirn, both of Austria

[73] Assignee: Julius Blum, Inc., Stanley, N.C.

Reexamination Request:
No. 90/001,928, Jan. 31, 1990

Reexamination Certificate for:
Patent No.: 4,045,841
Issued: Sep. 6, 1977
Appl. No.: 673,893
Filed: Apr. 5, 1976

[30] Foreign Application Priority Data

Apr. 7, 1975 [AT] Austria ..... 2623/75
Dec. 2, 1975 [AT] Austria ..... 9174/75

[51] Int. Cl.[5] ..... E05D 7/04; E05D 7/12
[52] U.S. Cl. ..... 16/238; 16/240; 16/246; 16/248; 16/249; 16/382; 16/DIG. 43; 16/254
[58] Field of Search ..... 16/238, 240, 246, 248, 16/249, 254, 382, DIG. 43

[56] References Cited

U.S. PATENT DOCUMENTS 2,781,542 2/1957 West .
3,562,853 2/1971 Heinze .
3,590,420 7/1971 Salice .
3,772,735 11/1973 Lautenschlaeger .
3,863,292 2/1975 Grunert et al. .
3,890,670 6/1975 Sewing et al. .
3,938,219 2/1976 Rock et al. .
3,952,364 4/1976 Lautenschaleger, Jr. .
3,952,366 4/1976 Rock et al. .
3,965,530 6/1976 Rock et al. .
3,977,041 8/1976 Rock et al. .
4,068,349 1/1978 Rock et al. .
4,075,735 2/1978 Rock et al. .
4,172,316 10/1979 Rock et al. .
4,176,422 12/1979 Rock et al. .
4,367,566 1/1983 Rock et al. .

FOREIGN PATENT DOCUMENTS 252061 2/1967 Australia .
820910 2/1975 Belgium .
1247077 8/1967 Fed. Rep. of Germany .
1809616 7/1969 Fed. Rep. of Germany .
7027759 7/1970 Fed. Rep. of Germany .
1554336 10/1971 Fed. Rep. of Germany .
2020591 11/1971 Fed. Rep. of Germany .
2025645 12/1971 Fed. Rep. of Germany .
2043622 6/1972 Fed. Rep. of Germany .
2356000 5/1975 Fed. Rep. of Germany .
2434863 12/1975 Fed. Rep. of Germany .
698648 11/1965 Italy .
1206798 9/1970 United Kingdom .
1374661 11/1974 United Kingdom .

*Primary Examiner*—Richard K. Seidel

[57] ABSTRACT

A hinge arrangement in which a base plate attachable to a part of furniture, provides an anchor for a hinge arm carrying toggle joints. The hinge arm has an end remote from mounting points of spindles of the toggle joints, which is provided with a longitudinal slot. A screw carried in the base plate, passes through the slot, and a holding shoulder is located directly or indirectly on the hinge arm between the longitudinal slot and the mounting points for the toggle joint spindles. The shoulder grips behind a projection on the base plate. The holding shoulder, furthermore, is disposed on an intermediate element connected adjustably with the hinge arm, and which is in the form of a female threaded element, receiving an adjusting screw held in the hinge arm.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–9 and 12–18 is confirmed.

Claims 10–11 are cancelled.

New claims renumbered 19–43 are added and determined to be patentable.

*19. A hinge arrangement comprising, in combination, a base plate having a support surface adapted to be applied to a side wall of furniture means; a hinge arm carrying toggle joint means and being anchorable onto said base plate; said toggle joint means having pivot means; said hinge arm having mounting means for mounting said pivot means at one end of said hinge arm; said hinge arm having a top wall with a longitudinal slot at the other end of said hinge arm which is spaced from said mounting means; screw means passing through said slot and carried in said base plate; said hinge arm including a holding shoulder spaced in a longitudinal direction between said longitudinal slot and said mounting means and spaced between said top wall and a plane containing said support surface of said base plate; projecting means on said base plate, said holding shoulder gripping under said projection means on said base plate.*

*20. The hinge arrangement as defined in claim 19 including an intermediate element supporting said holding shoulder, said intermediate element being connected adjustably with said hinge arm.*

*21. The hinge arrangement as defined in claim 20 including adjusting screw means in said hinge arm, said intermediate element comprising a female threaded element having a thread engaged by said adjusting screw means.*

*22. The hinge arrangement as defined in claim 20 including a female thread in said hinge arm, said intermediate element comprising a threaded bolt engaging said female thread in said hinge arm, said holding shoulder being substantially circular and being on the intermediate element at an end facing said plane containing said support surface.*

*23. The hinge arrangement as defined in claim 19 wherein said longitudinal slot has a keyhole shape.*

*24. The hinge arrangement as defined in claim 19 wherein said longitudinal slot is open to said other end of said hinge arm.*

*25. The hinge arrangement as defined in claim 24 wherein said longitudinal slot is beveled for receiving the head of a screw.*

*26. The hinge arrangement as defined in claim 24 including at least one projecting portion at one end of said longitudinal slot.*

*27. The hinge arrangement as defined in claim 19 including socket means on said base plate for receiving said screw means.*

*28. The hinge arrangement as defined in claim 19 including lateral guide walls in proximity of said projecting means for said hinge arm.*

*29. The hinge arrangement as defined in claim 28 including socket means on said base plate for receiving said screw means; a fixing plate between said socket means and said lateral guide walls above said base plate, said fixing plate being attachable to a part of said furniture means and holding the base plate to said furniture part when in assembled position, said fixing plate being substantially aligned with said base plate.*

*30. The hinge arrangement as defined in claim 29 including protrusions and recesses for connecting said base plate and said fixing plate.*

*31. The hinge arrangement as defined in claim 30 wherein said protrusions and recesses have side faces parallel to one another and substantially aligned with a longitudinal median axis of said hinge arm and said base plate.*

*32. The hinge arrangement as defined in claim 30 wherein said recesses are arranged in said base plate and said protrusions are arranged in said fixing plate.*

*33. The hinge arrangement as defined in claim 32 including supporting screws in said protrusions for supporting said fixing plate.*

*34. The hinge arrangement as defined in claim 29 including a vertical-adjustment screw connecting said base plate and said fixing plate together when in assembled position.*

*35. The hinge arrangement as defined in claim 19 wherein the projecting means defines an inverted T-shaped slot having a narrow portion and a wide portion, the wide portion being located closer to said plane than the narrow portion.*

*36. The hinge arrangement as defined in claim 35 wherein the inverted T-shaped slot extends in said longitudinal direction and opens at an end of the base plate facing the one end of the hinge arm at which the mounting means is located, the narrow portion of the inverted T-shaped slot being located between the top wall of the hinge arm and said plane.*

*37. A hinge arrangement comprising, in combination,* a base plate having front and rear ends thereof spaced apart in a longitudinal direction, the base plate having a support surface adapted to be applied to a side wall of furniture means;

*a hinge arm having corresponding front and rear ends thereof spaced apart in the longitudinal direction and being anchorable on the base plate;*

*the hinge arm having mounting means for mounting pivot means of joint means at the front end of the hinge arm;*

*the hinge arm having a top wall in which a longitudinal slot is open to the rear end of the hinge arm;*

*screw means on the base plate and passing through the slot of the hinge arm such that the hinge arm is fixed on the base plate when the screw means is tightened and is detachable from the base plate when the screw means is loosened;*

*the hinge arm including a holding shoulder spaced in the longitudinal direction between the front end and the rear end of the hinge arm and spaced between the top wall of the hinge arm and a plane containing said support surface of the base plate;*

*projecting means on the base plate defining a longitudinal slot which is open at an end thereof facing the front end of the base plate;*

*the holding shoulder gripping under the projecting means on the base plate when the hinge arm is placed onto the base plate and is pushed a short distance in the longitudinal direction.*

*38. A hinge arrangement according to claim 37 including a threaded bolt having a lower end facing said plane, the holding shoulder being arranged at the lower end, the threaded bolt having an upper end opposite to the lower end threadedly connected to the hinge arm.*

*39. A hinge arrangement according to claim 37 including a bolt threadedly connected with the hinge arm, the bolt having an end of substantially circular shape facing said plane and forming the holding shoulder, the bolt being threadedly connected with the hinge arm by means of a threaded part of the bolt engaging a female thread in the top wall of the hinge arm.*

*40. A hinge arrangement comprising, in combination,*

*a base plate having front and rear ends thereof spaced apart in a longitudinal direction, the base plate having a support surface adapted to be applied to a side wall of furniture means;*

*a hinge arm having corresponding front and rear ends thereof spaced apart in the longitudinal direction and being anchorable on the base plate;*

*the hinge arm having mounting means for mounting pivot means of joint means at the front end of the hinge arm;*

*the hinge arm having a top wall in which a keyhole-shaped longitudinal slot is disposed, the slot having a widened portion thereof located closer to the rear end of the hinge arm than a narrow portion thereof;*

*screw means on the base plate and passing through the slot of the hinge arm such that the hinge arm is fixed on the base plate when the screw means is tightened and is detachable from the base plate when the screw means is loosened;*

*the hinge arm including a holding shoulder spaced in the longitudinal direction between the front end and the rear end of the hinge arm and spaced between the top wall of the hinge arm and a plane containing said support surface of the base plate;*

*projecting means on the base plate defining a longitudinal slot which is open at an end thereof facing the front end of the base plate;*

*the holding shoulder gripping under the projecting means on the base plate when the hinge arm is placed onto the base plate and is pushed a short distance in the longitudinal direction.*

*41. A hinge arrangement according to claim 40 including a threaded bolt having a lower end facing said plane, the holding shoulder being arranged at the lower end, the threaded bolt having an upper end opposite to the lower end threadedly connected to the hinge arm.*

*42. A hinge arrangement according to claim 40 including a bolt threadedly connected with the hinge arm, the bolt having an end of substantially circular shape facing said plane and forming the holding shoulder, the bolt being threadedly connected with the hinge arm by means of a threaded part of the bolt engaging a female thread in the top wall of the hinge arm.*

*43. A hinge arrangement comprising, in combination, a base plate attachable to furniture means, a hinge arm carrying toggle joint means and being anchorable onto said base plate, said toggle joint means having pivot means; said hinge arm having means for mounting said pivot means at one end of said hinge arm; said hinge arm having a longitudinal slot at another end of said hinge arm spaced from said mounting means; screw means passing through said slot and carried by said base plate; said hinge arm including a holding shoulder between said longitudinal slot and said mounting means; projecting means on said base plate below a portion of the hinge arm and above the holding shoulder, said holding shoulder gripping under said projection means on said base plate, an intermediate element supporting said holding shoulder, said intermediate element being connected adjustably with said portion of said hinge arm, said portion of said hinge arm including a female thread, said intermediate element comprising a threaded bolt engaging said female thread in said hinge arm, said holding shoulder being substantially circular and being on the intermediate element at an end facing said base plate.*

* * * * *